US005794358A

United States Patent [19]

Robertson

[11] Patent Number: 5,794,358

[45] Date of Patent: Aug. 18, 1998

[54] APPARATUS FOR COOLING AND DRYING BULK PRODUCTS USING PRIMARY AND AUXILIARY AIR

[75] Inventor: Thomas W. Robertson, Merrimack, N.H.

[73] Assignee: Consolidated Process Machinery, Inc., Merrimack, N.H.

[21] Appl. No.: 874,041

[22] Filed: Jun. 12, 1997

[51] Int. Cl.[6] ..... F26B 17/12

[52] U.S. Cl. ..... 34/172

[58] Field of Search ..... 34/66, 65, 129, 34/136, 168, 172, 506, 509; 110/281, 291, 299; 432/77, 78

[56] References Cited

U.S. PATENT DOCUMENTS

| | | | |
|---|---|---|---|
| 1,100,397 | 6/1914 | Reynolds . | |
| 3,257,733 | 6/1966 | Ives et al. . | |
| 3,302,297 | 2/1967 | Graham . | |
| 3,710,449 | 1/1973 | Rathbun | 34/65 |
| 3,745,670 | 7/1973 | Hartwig | 34/217 |
| 3,913,242 | 10/1975 | Fackler et al. . | |
| 4,006,536 | 2/1977 | Meiners . | |
| 4,086,708 | 5/1978 | Westelaken . | |
| 4,445,282 | 5/1984 | Heinemans | 34/168 |
| 4,619,606 | 10/1986 | Numberger . | |
| 4,683,665 | 8/1987 | Geelen . | |
| 4,805,405 | 2/1989 | Jonsson | 60/39.464 |
| 5,443,539 | 8/1995 | Westelaken . | |
| 5,685,434 | 11/1997 | Ackerman | 209/135 |

*Primary Examiner*—Henry A. Bennett
*Assistant Examiner*—Steve Gravini
*Attorney, Agent, or Firm*—Nixon & Vanderhye

[57] ABSTRACT

A cooler/dryer includes a housing for storing bulk product including a bulk product inlet at the top of the housing and a grid structure adjacent the bottom of the housing for discharging bulk product. The grid structure is movable between open and closed positions and, in both positions, primary air flows upwardly through the grid structure to cool and/or dry the bulk product. Auxiliary air inlet ducts are located above the grid structure for flowing auxiliary air into the product bed. The primary air and the auxiliary air combine in the product bed to increase the cooling and/or drying effect without substantially increasing the velocity of the primary air through the grid structure which would otherwise affect the discharge rate of the product through the grid structure.

16 Claims, 5 Drawing Sheets

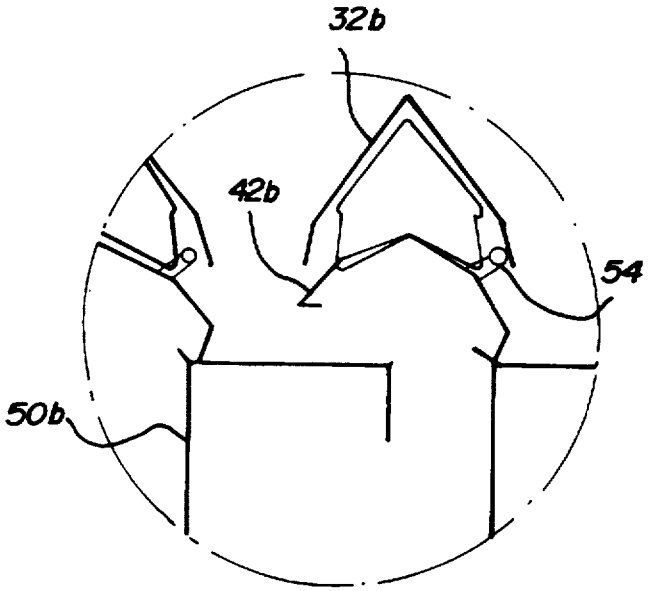
FIG. 4A
FIG. 4B
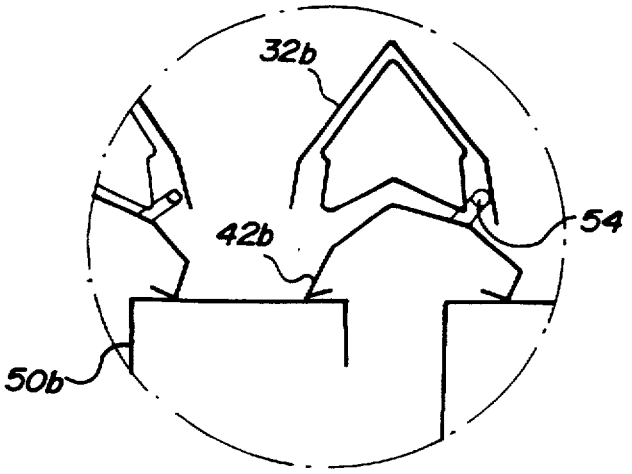

APPARATUS FOR COOLING AND DRYING BULK PRODUCTS USING PRIMARY AND AUXILIARY AIR

TECHNICAL FIELD

The present invention relates to apparatus for cooling and/or drying particulate material, including granular products such as pellets, meal and the like for the feed industry and particularly relates to novel and improved grate structure adjacent the bottom of the cooler housing in conjunction with auxiliary air inlet ducts above the grate structure for supplying primary and auxiliary air to the particulate material, respectively, whereby increased air flow through the particulate material without deleterious effect on material throughput is achieved.

BACKGROUND

A substantial number of cooler/dryer units have been proposed and constructed for cooling and/or drying particulate material, for example, feed used in the feed industry. The term feed means products which are used as feed for livestock, poultry and fish products farmers, although other types of particulate material may be cooled and/or dried with the cooler/dryer of the present invention. Such particulate material will be sometimes referred to herein as "product" or "bulk product." While horizontal cooler/dryers have been constructed for this purpose, vertical coolers/dryers are more common. In those vertical cooler/dryer units, there is provided a housing for receiving the product through an inlet adjacent an upper end of the housing and a grid structure at the base of the housing having at least one movable grate for discharging the product through a stationary grate. A typical example of such grid structure is disclosed in U.S. Pat. No. 5,375,342. The grid structure supports the product and prevents it from discharging from the housing when the grid structure is closed and permits air to pass upwardly through the grid structure for purposes of cooling and/or drying when the grid structure is both closed and opened.

In typical grid systems, the bulk product enters the housing through a rotary air inlet at the top of the housing and accumulates on top of the grid forming a product bed. The grid is formed of a movable grid overlaying a lower stationary grid. By reciprocating the movable grid over the lower stationary grid, the discharge of product is modulated through the grid system. Air is typically drawn in through an air inlet below the grid and passes up through the stationary and movable grates for flow through the product bed in the housing and exits through a ductwork adjacent the top of the housing.

The magnitude of the air required for cooling and/or drying the bulk product is directly proportional to the amount of product to be cooled and/or dried. Consequently, as product flow rate increases, the amount of air required likewise increases. Traditionally, all such air passes through the grid structure which has a fixed open area. Consequently, any increase in air volume results in increased air velocity through the grid structure. It has been found that the velocity can increase to the extent that the product will not discharge from the grid system or discharge at an adequate rate.

DISCLOSURE OF THE INVENTION

According to the present invention, there is provided a novel and improved grid structure for discharging bulk product, i.e., particulate material, and flowing primary cooling and/or drying air upwardly through the grid into the product bed within the housing in conjunction with an auxiliary air inlet system disposed above the grid structure in the product bed for flowing auxiliary cooling/drying air into the product. Because of the vacuum drawn in the housing, the auxiliary air and the primary air entering through the lower grid structure are combined in the product bed, hence increasing air circulation within the housing. The combined air flow exits through ductwork adjacent the top of the housing. Thus, the velocity of the air through the grid structure can be controlled without affecting product discharge rates while simultaneously increasing the magnitude of air flowing through the product for increased cooling and/or drying.

In one form of the present invention, the auxiliary air inlet system includes ducts extending between opposite sides of the housing and disposed in the product bed. The ducts comprise essentially inverted channels having an angled upper cap for guiding the product about the ducts. The bottoms of the ducts are open. Consequently, auxiliary air enters the product bed from the ducts and combines with primary air flowing upwardly through the grid structure for cooling and/or drying the product. Thus, increased air flow through the product bed is achieved without increasing the velocity of air flowing upwardly through the grid structure which might otherwise affect the discharge of the product from the housing.

In another preferred form of the present invention, an element is disposed in the open bottom of each duct and defines at least one, preferably two auxiliary air outlet passages for discharging auxiliary air into the product bed surrounding the ducts. The elements are spaced above the grid structure and provide a substantially uniform distribution of auxiliary air flow into the product bed along opposite sides of the ducts.

In a further preferred form of the invention, each element also cooperates with a movable grid to modulate the discharge of the product from the housing and permit inflow of primary air through the grid/element combination. Particularly, the grid includes a plurality of generally parallel grate bars spaced one from the other defining channels therebetween and extending between opposite sides of the housing. The auxiliary air inlet ducts lie in vertical registration with the channels between the grate bars and extend generally parallel to the grate bars. The elements are disposed between the overlying ducts and the underlying grate bars. The elements preferably have a multi-sided inverted generally U-shaped configuration overlying the spaces between the grate bars. One edge of each element bears on a grate bar, while the opposite edge is spaced from an adjacent grate bar, the latter spacing defining an elongated aperture providing part of the discharge opening for the product and the primary air inlet opening. Preferably, the elements are pivotally secured to the housing such that the aperture between the edge and grate bar can be adjusted and fixed in adjusted position dependent upon the type and size of product being cooled and/or dried.

In operation, the elements overlie the spaces between the grate bars. While the one edge of the element is spaced from the grate bar, a substantial portion of that grate bar underlies the element, preventing product from flowing through that aperture and into the channel between adjacent grate bars. To discharge the product, the grate bars are displaced horizontally, i.e., retracted, relative to the elements such that product disposed on the upper surface of the grate bars may flow over their edges into the channels between the grate bars for discharge from the housing. The grate bars are preferably reciprocated between a ready position where product is disposed on the grate bars ready for discharge, and a discharge position where product flows through the apertures between the elements and grate bars and into the channels between the grate bars for discharge. To obtain a clean-out position, the grate bars may be fully displaced such that the spaces between the adjacent elements and the channels between adjacent grate bars lie in vertical registration with one another whereby product discharges directly and vertically downwardly from the housing. It will be appreciated that primary air flows up through the grid between the grate bars and the apertures between the grate bars and the edges of the elements for flow into the product in the housing. Auxiliary air also flows through the ducts and into the product. The primary and auxiliary air flows combine in the product bed and flow upwardly and outwardly of the housing under vacuum pressure. It will be appreciated that by supplying auxiliary air directly to the bed, the velocity of the primary air flow through the grid structure need not be increased to increase the quantity of air flow through the system for purposes of cooling and/or drying the product. Thus, product discharge is not affected by the increased air flow.

In a preferred embodiment according to the present invention, there is provided apparatus for circulating air through particulate material, comprising a housing defining a particulate material storage volume and having a particulate material inlet and a grate adjacent a bottom of the housing forming openings for flowing material from the volume and for flowing primary air upwardly through the grate and into the material in the volume, a plurality of ducts above the grate for flowing auxiliary air into the material in the volume and an air mover for drawing primary air through the openings of the grate and auxiliary air from the ducts into the material in the volume.

In a further preferred embodiment according to the present invention, there is provided apparatus for circulating air through particulate material, comprising a housing for storing particulate material, a particulate material inlet to the housing, a plurality of spaced grate bars extending generally parallel to one another between opposite sides of the housing and mounted for generally horizontal reciprocating movement, the grate bars defining channels therebetween, a plurality of spaced ducts extending generally parallel to one another and between the opposite sides of the housing, the ducts having auxiliary air inlets opening through the housing and auxiliary air outlet openings along undersides of the ducts for directing auxiliary air into the material within the housing, the ducts being disposed above the grate bars generally at locations in vertical registration with channels between the grate bars, elements underlying the ducts and the auxiliary air outlet openings thereof, respectively, and generally overlying the channels between the grate bars, each element defining with the auxiliary air outlet of an overlying duct a passage for flowing auxiliary air into the particulate material in the housing, at least one edge of each element being spaced above an underlying registering grate bar to define therewith an aperture for in part discharging particulate material from the housing and in part defining an inlet for flowing primary air into the housing and an air mover for displacing primary air through the channels between the grate bars and the apertures and auxiliary air through the ducts and auxiliary air outlet openings for flow through the particulate material within the housing.

Accordingly, it is a primary object of the present invention to provide a novel and improved cooler/dryer for cooling and discharging particulate material.

BRIEF DESCRIPTION OF THE DRAWINGS

FIGS. 4A and 4B are enlarged fragmentary views illustrating the range of movement of an element forming part of the discharge for the cooler/dryer hereof.

BEST MODE FOR CARRYING OUT THE INVENTION

Figure 1:
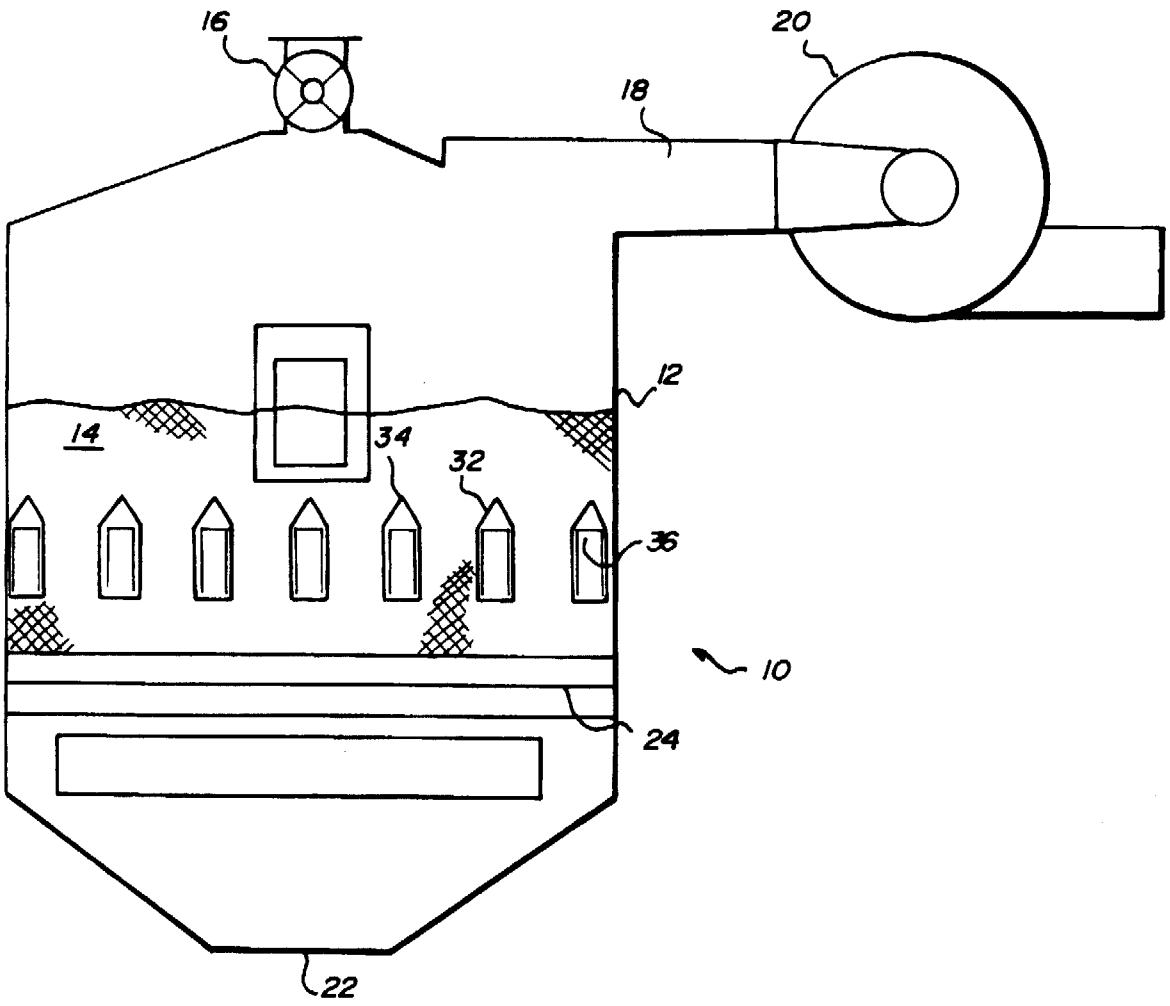
FIG. 1 is a schematic side elevational view of a cooler/dryer constructed in accordance with the present invention.

Referring now to FIG. 1, there is illustrated a cooler/dryer unit constructed in accordance with the present invention and generally designated 10. Unit 10 includes a housing 12 defining a volume 14 for storing and cooling and/or drying particulate material such as feed pellets, meal and the like. At the upper end of the housing 12, there is provided a rotary air feed inlet 16 and duct work 18 coupled to a fan or air mover 20 or drawing cooling and/or drying air through the housing 12 and product in storage volume 14, as will be explained. At the bottom of the housing 12, there is provided a discharge opening 22 and a grid structure 24.

Figure 2:
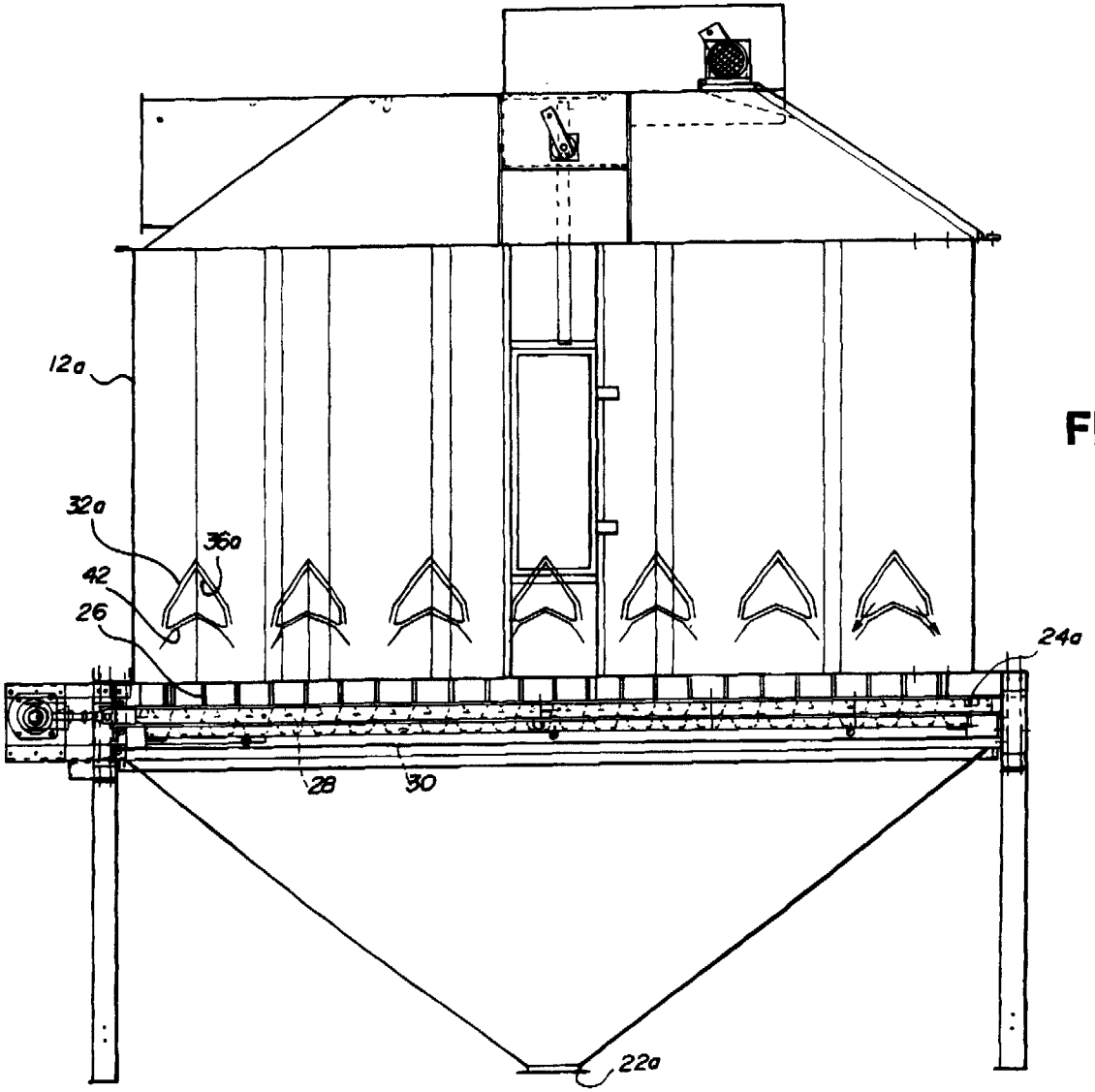
FIG. 2 is a schematic side elevational view with parts broken out for clarity of a second form of cooler/dryer according to the present invention.

Referring to FIG. 2, which illustrates a second form of the present invention but which also illustrates a grid structure useful for both embodiments of FIGS. 1 and 2, the grid structure 24 may include an upper stationary grid 26, an intermediate movable grid 28 and a lower stationary grid 30. By reciprocating the intermediate movable grid 28 relative to the fixed grids, product may be discharged through the grid structure 24 to the discharge 22. In another position of the intermediate grid, it cooperates with the lower fixed grid 30 to preclude discharge of the product through the grid structure 24. By reciprocating the intermediate grid at different rates, the throughput of the unit can be varied. Importantly, however, grid structure 24 does not prevent upward air flow through the grid into the product disposed in the volume 14 (FIG. 1) when a vacuum is drawn in the housing 12 by fan 20. That is, air may be drawn through the housing for cooling and/or drying the product while the grid is closed or opened. The grid structure may be of the type disclosed in U.S. Pat. No. 4,683,665.

Referring to FIG. 1, and in addition to the primary air drawn into the cooler/dryer by the fan 20 through grid 24, there is provided a plurality of ducts 32 extending between opposite sides of the housing 12. The ducts 32 form inverted channels extending generally parallel to one another and between opposite side walls of housing 12. Each duct 32 has a channel cover or angled cap 34 for guiding the product within housing 12 on opposite sides of the duct en route to the grid structure for discharge. Each duct 32 communicates at one end with an opening 36 through a side wall of the housing for receiving ambient air. An opening 36 may also be provided at opposite ends of the ducts. Air is inducted by the fan 20 and hence drawn inwardly through the side wall openings for flow into the ducts and downwardly through the open bottoms of the ducts and into the product in storage volume 14. With the ducts spaced above the grid structure 24, the vacuum drawn in the housing by fan 20 causes primary air to flow upwardly through grid structure 24 and auxiliary air to flow into the ducts and downwardly out of the ducts 32 into the product. The primary and auxiliary air then combine in the product bed and flow upwardly, cooling and/or drying the product. The combined air then flows outwardly of the housing by way of fan 20. The inlets to the ducts may be provided with deflectors for varying the openings of the auxiliary air inlets to control, if necessary, the amount of air moved through the grid structure 24.

Referring now to FIG. 2, there is illustrated a further preferred embodiment hereof wherein like reference numerals apply to like parts, followed by the suffix "a." In this form, the ducts 32*a* include inverted, generally V-shaped channels in communication with similarly shaped inlet openings 36*a* through one or both of the side walls of the housing 12*a*. Below the open bottom of the ducts 32*a*, there is provided an elongated element 42 formed in the shape of an inverted multi-sided generally U-shaped channel. The elements 42 are spaced above the grid structure 24*a*. As a consequence of this arrangement, air drawn through the auxiliary inlet openings 36*a* in one or both sides of the housing flows along the ducts and is drawn through the elongated passages between the lower edges of ducts 32*a* and the outer edges of elements 42 for flow into the product within housing 12*a*. Thus, the primary air inducted through the grid system and the auxiliary air inducted through the auxiliary air inlet ducts 32*a* is combined in the product bed in areas between the auxiliary air inlet ducts and the grid system for flow upwardly through the product for exit through and discharge by a blower, not shown, in drawing FIG. 2. This arrangement effects a substantially uniform distribution of air within the housing and, as in the first embodiment, enables the velocity of primary air flowing through the grid structure 24*a* to be maintained at a sufficiently low level to not affect the flow rate of product discharged from the housing.

Figure 5:
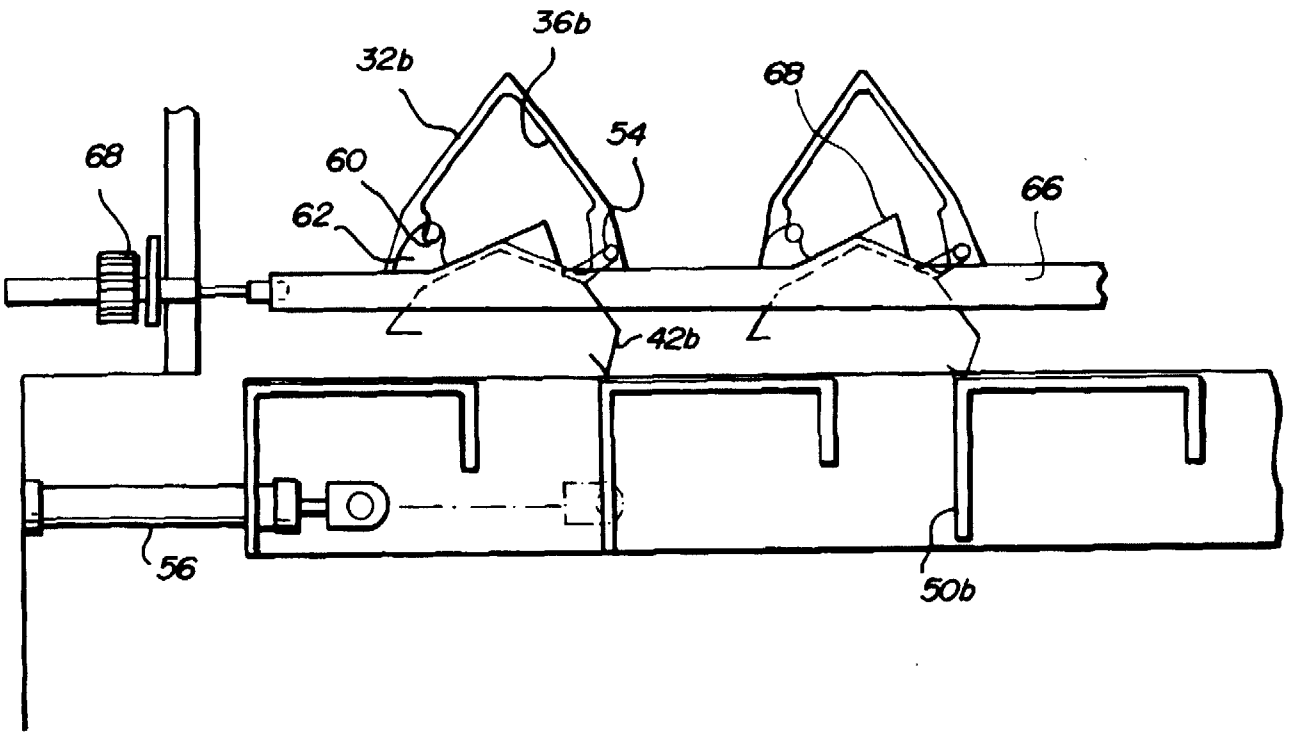
FIG. 5 is an enlarged fragmentary side elevational view illustrating the mechanism by which the elements are adjusted in position.

Referring now to the form of the invention illustrated in FIGS. 3–5, wherein like reference numerals apply to like parts as in prior embodiments, followed by the suffix "b," the grid structure 24*b* may comprise a single grid mounted to the side walls of the housing for horizontal reciprocating movement. The grid structure 24*b* may comprise a plurality of grate bars 50 extending generally parallel to one another and spaced from one another to define channels therebetween for discharging product from the housing. The channels between the grate bars 50 also receive primary air for flow upwardly through the grid structure 24*b*. The grate bars 50 may be inverted channels as illustrated. In this form of the invention, the ducts 32*b* extend between opposite sides of the housing and lie in communication with auxiliary air inlet openings 36*b* at one or both ends of the ducts 32*b*. The ducts 32*b* are preferably in the form of a generally triangularly-shaped inverted channels, the auxiliary air inlet openings 36*b* forming complementary openings at the ends of the housing. The elements 42*b* is similarly shaped as previously described and underlie the open bottoms of the ducts 32*b*. As illustrated, the space between the lower edges of the duct 32*b* and the outer margins of the elements 42*b* define passageways for channeling auxiliary air inlet flowing through ducts 32*b* into the product at a location just above the grate bars 50 and between the ducts 32*b*.

As illustrated in FIG. 5, the elements 42*b* are pivotally mounted to the housing 12*b*. Particularly, brackets extend from opposite ends of elements 42*b* for mounting to pivot points or pins 54 fixed relative to the housing. The elements 42*b* are thus pivotable about pivot points 54 between extreme open and closed positions illustrated in FIGS. 4A and 4B, respectively, with respect to the apertures between the grate bars 50*b* and one of the lower edges of element 42*b*. As will be seen from the ensuing description, the elements 42*b* are pivoted in unison to an adjusted position with a defined aperture between a lower edge of one leg of element 42*b* and the upper surface of the underlying grate bar 50*b*. The inclination of the elements 42*b* is selectively adjustable to adjust the size of the aperture. In FIG. 4B, the element 42*b* is pivoted into a fully closed position with opposite legs of element 42*b* engaging adjacent grate bars 50*b*. As illustrated in FIGS. 3A–3D, each element 42*b* overlies the channel between adjacent underlying grate bars 50*b*, preventing direct downward flow of the product into the space between the grate bars. In the closed position of the cooler illustrated in FIG. 3A, product flows about the ducts 32*b* and the elements 42*b*. To the extent the product passes inwardly of the raised lower edge of the element 42*b*, i.e., through the aperture, the product is supported on the upper surface of the underlying grate bar and sufficient area of the grate bar remains to prevent product flow into the channel between the adjacent grate bars. The arrangement precludes discharge of the product from the housing. It will be appreciated that the channels between the grate bars and the apertures between the lower edges of elements 42*b* and the upper surfaces of grate bars 52*b* permit primary air to flow upwardly through the grid structure and into the product in the housing for cooling and/or drying the product in both closed and opened positions of elements 42*b* relative to the grate bars 50*b*.

Figure 3A:
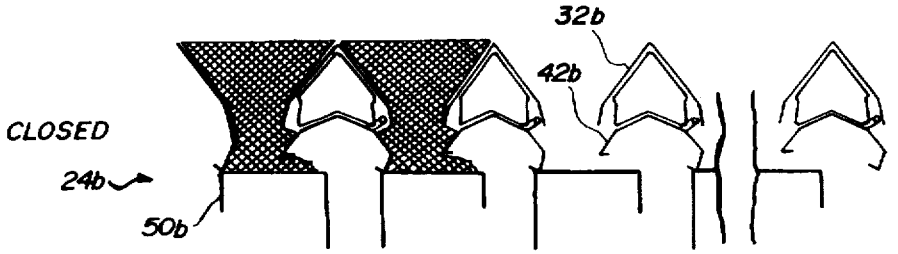
FIGS. 3A–3E are schematic representations of the operation of a still further form of the present invention.
Figure 3B:
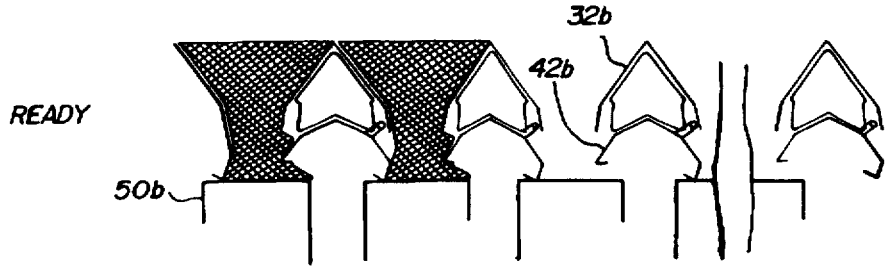
Figure 3C:
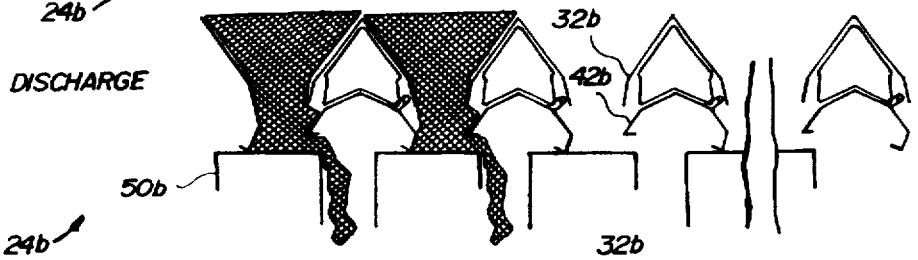
Figure 3D:
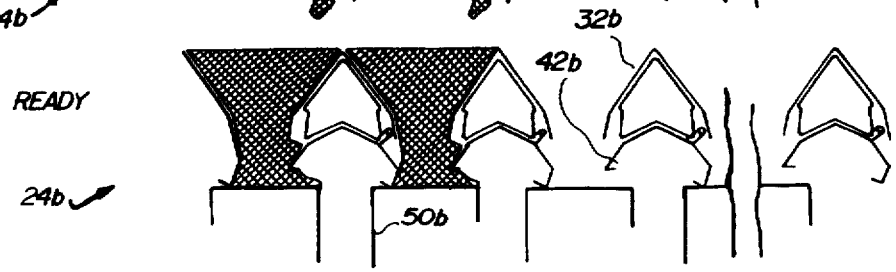
Figure 3E:
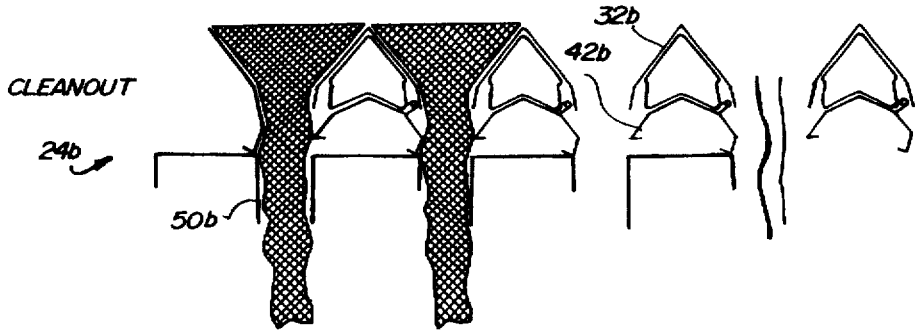

To discharge product from the housing, the grid structure is displaced horizontally, i.e., retracted to a ready position, illustrated in FIG. 3B, e.g., by a fluid-actuated cylinder 56. In this position, it will be seen that the product approaches the edge of the grate bar underlying each of the spaced edges of the element 42*b*. Further retraction of the grid causes the grate bars to move out from under the product accumulated on the upper surface of the bar, enabling the product to flow into the spaces between the adjacent grate bars for discharge. It will be appreciated that while product is discharged, primary air flows upwardly between the grate bars and between the lower edges of the elements 42*b* and the upper surfaces of the underlying grate bars, i.e., the apertures, for cooling and/or drying the product in the housing. The flow of product through the grid structure may be modulated by the rate of reciprocation of the grid structure. At the end of a run and as illustrated in FIG. 3E, the grid structure may be fully retracted or displaced to register the grate bars 50 vertically below the elements 42*b*, thus vertically registering the spaces between the ducts and the spaces between the grate bars. This enables a complete clean-out of the product from the storage volume within the housing.

Referring now to FIG. 5, the apertures between the lower edges of the elements 42*b* and the upper surfaces of the grate bars can be adjusted. To accomplish this, a pin 60 is attached by a bracket 62 to each element 42*b*. An actuating rod 66 is longitudinally movable relative to the pin 60 by a jack screw 68. The rod 66 has a plurality of ramps 68 spaced therealong for engaging the pin 60. Upon engagement and further retraction of the rod, the elements can be further pivoted about their pivot points 54 into selected adjusted positions whereby the apertures between the upper surfaces of the grate bars and lower edges of elements 42*b* can be adjusted. It will be appreciated that additional rods 66 with pin 60 engaging elements can be provided such that individual or groups of elements 42*b* may be selectively pivoted.

It will be appreciated from the foregoing description that the present invention provides both primary air and auxiliary air for cooling and/or drying purposes, with the beneficial results that product may always be discharged from the grid system without the cooling and/or drying air interfering with the discharge rate. Additionally, the auxiliary system enables control of the amount of air moved through the grid, with the result that additional air can be pulled through the material within the housing without exceeding the maximum air velocity beyond which the product discharge rate would be affected.

While the auxiliary air inlets the air velocity limitations through the grid, the velocity of the air leaving the top surface of the product bed within the housing may cause fines to be lifted with the air stream and sucked into the air mover. To decrease that velocity, the sides of the housing can be flared outwardly and upwardly to reduce the velocity of the exiting air. Thus, the four side walls of a generally rectilinear housing may flare upwardly away from one another. Similarly if other housing shapes are employed, such as circular in plan, the circular side walls may diverge in an upward direction.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. Apparatus for circulating air through particulate material, comprising:

a housing defining a particulate material storage volume and having a particulate material inlet and a grate adjacent a bottom of said housing forming openings for flowing material from said volume and for flowing primary air upwardly through the grate and into the material in said volume;

a plurality of ducts above said grate for flowing auxiliary air into the material in said volume; and an air mover for drawing primary air through the openings of said grate and auxiliary air from said ducts into the material in said volume.

2. Apparatus according to claim 1 wherein each of said ducts has an open bottom, a member for guiding material along opposite sides of said duct and an element in said open bottom spaced from said duct to define at least one flow passage from said duct into the material in said volume.

3. Apparatus according to claim 2 wherein said openings are defined in part between said elements and said grate, said grate being carried by said housing for reciprocating movement between first and second positions, in cooperation with said elements, enabling flow of said material from said volume through said openings and precluding flow of material through said openings, respectively, said grate in said first and second positions enabling flow of air through said openings into the material in said volume.

4. Apparatus according to claim 3 wherein said grate includes a plurality of grate bars underlying said elements, respectively, each said grate bar lying in vertical registration with a space between adjacent elements when said grate bars lie in said second position, at least one edge of each said element being spaced from an underlying grate bar in said first position of said grate bars.

5. Apparatus according to claim 4 wherein said one edge of each said element is spaced from said underlying grate bar in the second position of said grate.

6. Apparatus according to claim 4 wherein said elements are carried by said housing for movement relative to said grate bars to adjust the space between said one edge and said underlying grate bar.

7. Apparatus according to claim 4 wherein said elements are carried by said housing for pivotal movement into adjusted positions relative to the underlying grate bars to adjust the size of the space between said one edge and said underlying grate bar, and means for fixing the elements in adjusted pivoted positions.

8. Apparatus according to claim 4 wherein said elements are carried by said housing for movement relative to the grate bars between positions enabling discharge of particulate material through said grate and closing off said grate to discharge of the particulate material.

9. Apparatus according to claim 4 wherein said elements are carried by said housing for movement relative to said grate bars between positions enabling flow of primary air through said grate and blocking flow of primary air through said grate.

10. Apparatus for circulating air through particulate material, comprising:

a housing for storing particulate material;

a particulate material inlet to said housing;

a plurality of spaced grate bars extending generally parallel to one another between opposite sides of said housing and mounted for generally horizontal reciprocating movement, said grate bars defining channels therebetween;

a plurality of spaced ducts extending generally parallel to one another and between said opposite sides of said housing, said ducts having auxiliary air inlets opening through said housing and auxiliary air outlet openings along undersides of said ducts for directing auxiliary air into the material within said housing, said ducts being disposed above said grate bars generally at locations in vertical registration with said channels between said grate bars;

elements underlying said ducts and said auxiliary air outlet openings thereof, respectively, and generally overlying said channels between said grate bars, each said element defining with said auxiliary air outlet of an overlying duct a passage for flowing auxiliary air into the particulate material in said housing, at least one edge of each said element being spaced above an underlying registering grate bar to define therewith an aperture for in part discharging particulate material from said housing and in part defining an inlet for flowing primary air into said housing; and an air mover for displacing primary air through said channels between the grate bars and the apertures and auxiliary air through the ducts and auxiliary air outlet openings for flow through the particulate material within the housing.

11. Apparatus according to claim 10 wherein each of said elements defines with said auxiliary air outlet of an overlying duct a second passage for flowing auxiliary air into the particulate material in said housing.

12. Apparatus according to claim 10 wherein each said element has an opposite edge in engagement with an underlying grate bar.

13. Apparatus according to claim 10 wherein groups of said elements are carried by said housing for movement relative to said grate bars to selectively adjust the aperture between said one edge and said underlying grate bar.

14. Apparatus according to claim 13 wherein each of said elements is pivotally carried by said housing, and means for fixing an element in selected adjusted position relative to said grate bars.

15. Apparatus according to claim 10 wherein said elements are carried by said housing for movement relative to the grate bars between positions enabling discharge of particulate material through said grate and closing off said grate to discharge of the particulate material.

16. Apparatus according to claim 10 wherein said elements are carried by said housing for movement relative to said grate bars between positions enabling flow of primary air through said grate and blocking flow of primary air through said grate.

* * * * *